US006092744A

United States Patent [19]

Youakim

[11] Patent Number: 6,092,744

[45] Date of Patent: Jul. 25, 2000

[54] FUEL INJECTOR WITH PRESSURE REGULATED TRAPPED VOLUME NOZZLE ASSEMBLY

[75] Inventor: Mike Youakim, Milwaukee, Wis.

[73] Assignee: Caterpillar, Inc., Peoria, Ill.

[21] Appl. No.: 09/130,917

[22] Filed: Aug. 7, 1998

[51] Int. Cl.[7] ..... F02M 59/00

[52] U.S. Cl. ..... 239/533.2; 239/88; 239/533.8

[58] Field of Search ..... 239/88, 89, 90, 239/91, 533.2, 533.8, 533.9

[56] References Cited

U.S. PATENT DOCUMENTS

| | | | |
|---|---|---|---|
| 3,131,866 | 5/1964 | Cummings et al. . | |
| 3,469,793 | 9/1969 | Guertler . | |
| 3,738,576 | 6/1973 | O'Neill | 239/533 |
| 3,797,753 | 3/1974 | Fenne et al. | 239/533 |
| 4,205,789 | 6/1980 | Raufeisen | 239/533.3 |
| 4,213,434 | 7/1980 | Vogtmann et al. | 123/462 |
| 4,213,564 | 7/1980 | Hulsing | 239/88 |
| 4,261,513 | 4/1981 | Andrews | 239/125 |
| 4,836,454 | 6/1989 | Gaskell | 239/533.9 |
| 4,941,613 | 7/1990 | Hardy et al. | 239/124 |
| 4,979,676 | 12/1990 | Heln | 239/95 |
| 5,035,221 | 7/1991 | Martin | 123/451 |
| 5,353,992 | 10/1994 | Regueiro | 239/533.12 |
| 5,429,309 | 7/1995 | Stockner | 239/533.8 |

FOREIGN PATENT DOCUMENTS

| | | |
|---|---|---|
| 3008209 | 9/1981 | Germany . |
| 2 203 795 | 10/1988 | United Kingdom . |
| 2 333 804 | 8/1999 | United Kingdom . |

*Primary Examiner*—Steven O. Douglas
*Assistant Examiner*—Huyen Le
*Attorney, Agent, or Firm*—Michael B. McNeil

[57] ABSTRACT

A fuel injector includes an injector body that defines a low pressure space, a trapped volume and a fuel pressurization chamber in fluid communication with a nozzle outlet. A needle valve member is positioned in the injector body and moveable between an inject position in which the fuel pressurization chamber is open to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. At least one of the needle valve member and the injector body define a pressure release passage extending between the trapped volume and the low pressure space. A pressure regulating valve is positioned in the pressure release passage, and has a regulating valve member that is moveable to an open position when fluid pressure in the trapped volume is above pop-off pressure.

20 Claims, 3 Drawing Sheets

INJECTION PRESSURE
MAXIMUM VOP
(PRIOR ART)
BIASING SPRING
PRESSURE FORCE
(SPRING 39)
MAXIMUM VOP
(WITH INVENTION)
BIASING SPRING
PRESSURE FORCE
(SPRING 39)
POP-OFF PRESSURE
(SPRING 52)
MINIMUM VOP
MAXIMUM TVN PRESSURE
BIASING SPRING
PRESSURE FORCE
(SPRING 39)
PRESSURE ON NEEDLE VALVE MEMBER
IDLE
RATED
OPERATING CONDITION

FUEL INJECTOR WITH PRESSURE REGULATED TRAPPED VOLUME NOZZLE ASSEMBLY

TECHNICAL FIELD

The present invention relates generally to fuel injectors, and more particularly to nozzle assemblies for fuel injectors that employ a trapped volume above the needle valve member.

BACKGROUND ART

In many fuel injectors, a simple spring biased needle check is used to open and close the nozzle outlet. The needle valve member typically includes at least one lifting hydraulic surface that is acted upon by fuel pressure. A compression spring is positioned to bias the needle toward its closed position. When fuel pressure rises above a valve opening pressure sufficient to overcome the spring, the needle valve member lifts to open the nozzle outlet to commence an injection event. Each injection event ends when fuel pressure drops below a pressure necessary to keep the needle valve open against the action of the biasing spring. When this occurs, the spring pushes the needle valve member downward to its closed position to end the injection event.

An improvement on the simple spring bias needle check is described in U.S. Pat. No. 5,429,309 to Stockner, which improvement is more commonly known as a trapped volume nozzle. In a typical fuel injector employing a trapped volume nozzle, the compression biasing spring and one end of the needle valve member are positioned in a closed volume space. During an injection event, high pressure fuel migrates up the outer surface of the needle valve member into the trapped volume. In addition, movement of one end of the needle valve member into the trapped volume will compress the fuel therein. Both of these phenomena raise pressure in the trapped volume to relatively high pressures, which sometimes are in excess of 20 MPa. The purpose of the trapped volume is to increase the speed at which the needle valve member moves to its closed position at the end of an injection event. Those skilled in the art are well aware that in most instances it is desirable to make an injection event end as abruptly as possible in order to decrease undesirable noise and improve emissions from the engine. The trapped volume nozzle achieves this goal by having the needle valve member pushed toward its closed position at the end of an injection event not only by the force of the biasing spring but also by a hydraulic force due to the built-up pressure in the trapped volume that acts on one end of the needle valve member.

Although the concept of a trapped volume nozzle has proved sound in hastening the closure rate of the needle valve member, some undesirable side effects have been observed. In some instances, the relatively high pressure developed in the trapped volume during an injection event is unable to decay to a relatively low pressure between injection events. This has the effect of raising the valve opening pressure for a subsequent injection event since the needle valve member is being held closed by hydraulic pressure in addition to the force of the compression biasing spring. While the ability to have a variable valve opening pressure can in some cases be desirable, predictability problems can sometimes develop because of the differing behavior between individual injectors, and malfunctioning can sometimes occur when the injector drops quickly from a rated operating condition to an idle operating condition. In some instances, injector locking can occur in those cases where fuel pressures at idle conditions are significantly lower than that at a rated condition. In some instances, the valve opening pressure for the injector can be too high when the injector drops from a rated condition to an idle operating condition. When this occurs, idle injection pressure is too low to lift the needle valve member to its opened position, no injection occurs, and the engine ceases to operate. In addition, high trapped volume pressures can cause the needle valve member to close so quickly that the nozzle tip of the injector is damaged.

The present invention is directed to overcoming these and other problems associated with the fuel injectors employing trapped volume nozzle technology.

DISCLOSURE OF THE INVENTION

A fuel injector includes an injector body that defines a low pressure space, a trapped volume and a fuel pressurization chamber in fluid communication with a nozzle outlet. A needle valve member is positioned in the injector body and movable between an inject position in which the fuel pressurization chamber is open to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. At least one of the needle valve member and the injector body define a pressure release passage extending between the trapped volume and the low pressure space. A pressure regulating valve that is positioned in the pressure release passage has a regulating valve member that is movable to an open position when fluid pressure in the trapped volume is above a pop-off pressure.

In another embodiment, a first compression spring is operably positioned in the trapped volume to bias the needle valve member toward its closed position. A second biasing spring is operably positioned outside of the trapped volume to bias the regulating valve member toward its closed position.

In another embodiment, a fuel injector includes an injector body that defines a trapped volume and a fuel pressurization chamber, which is in fluid communication with a nozzle outlet. A needle valve member is positioned in the injector body and moveable between an inject position in which the fuel pressurization chamber is open to the nozzle outlet, and a closed position in which the nozzle outlet is blocked to the fuel pressurization chamber. The needle valve member includes a lifting hydraulic surface exposed to fluid pressure in the fuel pressurization chamber, and a closing hydraulic surface exposed to fluid pressure in the trapped volume. The needle valve member is moveable toward its inject position when fuel pressure in the fuel pressurization chamber is above a valve opening pressure. Finally, the fuel injector includes a means for varying the valve opening pressure.

BEST MODE FOR CARRYING OUT THE INVENTION

Figure 1:
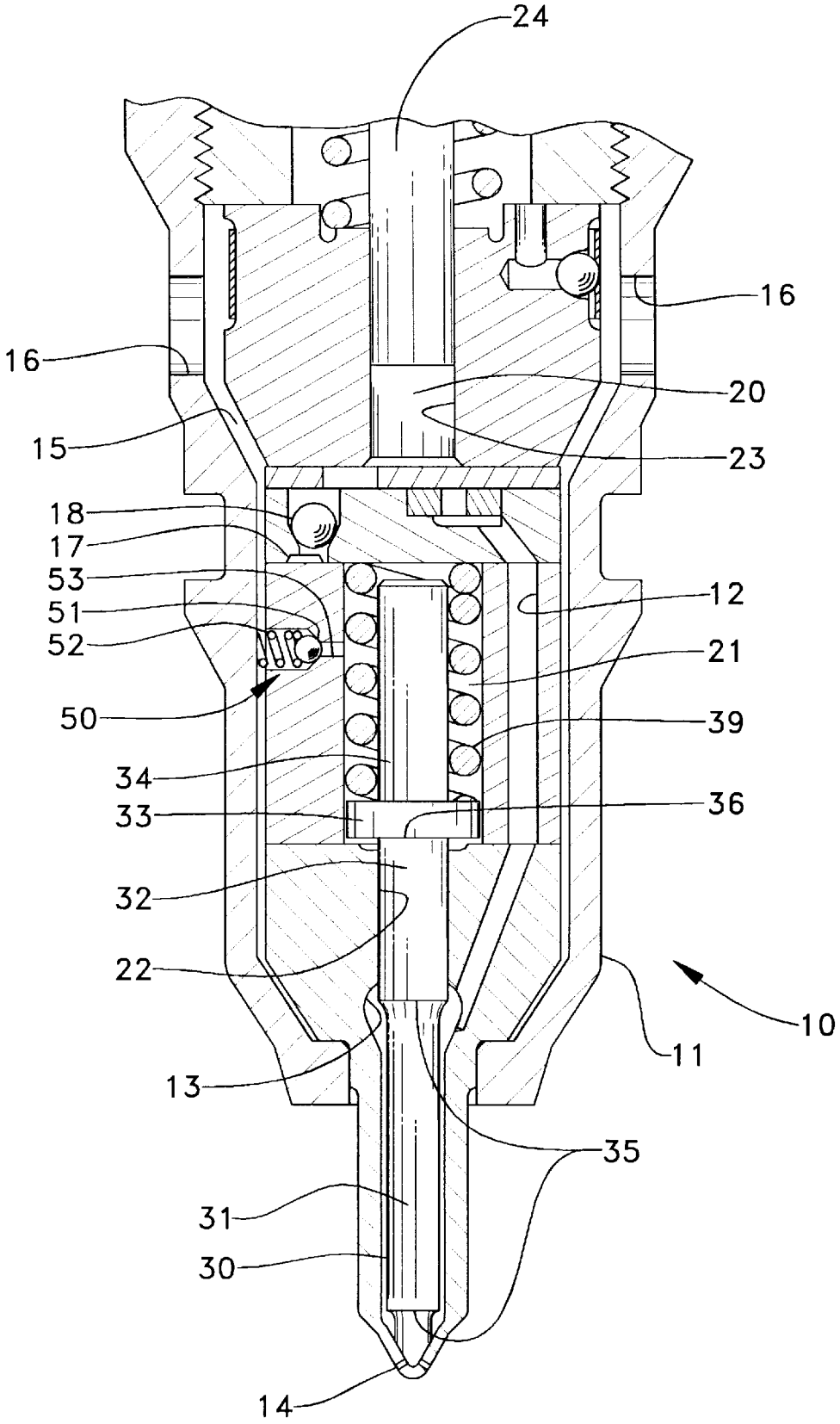
FIG. 1 is a partial front sectioned diagrammatic view of a fuel injector according to the present invention.

Referring now to FIG. 1, a fuel injector 10 includes an injector body 11 made up of a plurality of machined components attached to one another in a manner well known in the art. Injector body 11 defines a fuel pressurization chamber 20 in fluid communication with a nozzle outlet 14 via a nozzle supply passage 12 and a nozzle chamber 13. Fuel pressurization chamber 20 is defined by a portion of plunger bore 23 and one end of plunger 24. Fuel is pressurized when plunger 24 is driven downward by some appropriate means, such as a cam/tappet assembly or a hydraulically driven piston. In either case, those skilled in the art will appreciate that injection pressures are generally made to vary across the operating range of the individual injector. For instance, injection pressures at idle conditions are generally substantially lower than injection pressures at rated conditions.

Between injection events, plunger 24 retracts and draws fresh fuel into fuel pressurization chamber 20. This fuel enters injector body 11 at fuel inlet 16, travels along low pressure fuel supply passage 15, into fuel supply passage 17, past check valve 18, and into fuel pressurization chamber 20. Check valve 18 prevents the reverse flow of fuel when plunger 24 is undergoing its downward pumping stroke during an injection event.

As in a typical fuel injector, a needle valve member 30 is positioned in injector body 11 and is moveable between an inject position in which nozzle outlet 14 is open, and a closed position, as shown, in which nozzle outlet 14 is blocked to nozzle chamber 13. Needle valve member 30 includes a needle portion 31, a guide portion 32, a spacer portion 33 and a pin stop portion 34. Needle valve member 30 is guided in its up and down movement by the relatively small clearance between guide portion 32 and guide bore 22. Needle valve member 30 is normally biased toward its downward closed position by a compression spring 39, which is positioned within a trapped volume 21. The relatively small clearance area between guide portion 32 and guide bore 22 substantially isolates trapped volume 21 from nozzle chamber 13. Nevertheless, during injection events, when pressure in nozzle chamber 13 is relatively high, some fluid pressure migrates up guide bore 22 to raise pressure within trapped volume 21. Thus, at any given time, the total force tending to push needle valve member 30 toward its downward closed position is the sum of the spring force produced by biasing spring 39 and the hydraulic force produced by fluid pressure in trapped volume 21 acting on closing hydraulic surface 36. In order for needle valve member to open, this closing force must be overcome by an upward opening force produced by hydraulic fluid pressure acting on lifting hydraulic surfaces 35, which are located in nozzle chamber 13. Thus, in order to move to its open position, the lifting force on needle valve member 30 must be greater than the closing force.

In order to insure that needle valve member 30 always has the ability to open, a pressure regulating valve 50 is operably positioned in a pressure relief passage 53 that extends between trapped volume 21 and the low pressure space defined by low pressure fuel supply passage 15. Pressure regulating valve 50 includes a ball valve member 51 that is biased toward a closed position by a spring 52. Thus, pressure regulating valve 50 is normally closed, but is moveable to an open position to release pressure in trapped volume 21 when fluid pressure acting on ball valve member 51 is greater than a pop-off pressure sufficient to overcome spring 52. By choosing an appropriate spring strength, one can control the pop-off pressure. This insures that the advantages of a trapped volume nozzle assembly can be obtained, yet insure that the needle valve member always has the ability to open, even when the injector is rapidly dropped from a rated to an idle operating condition.

Figure 2:
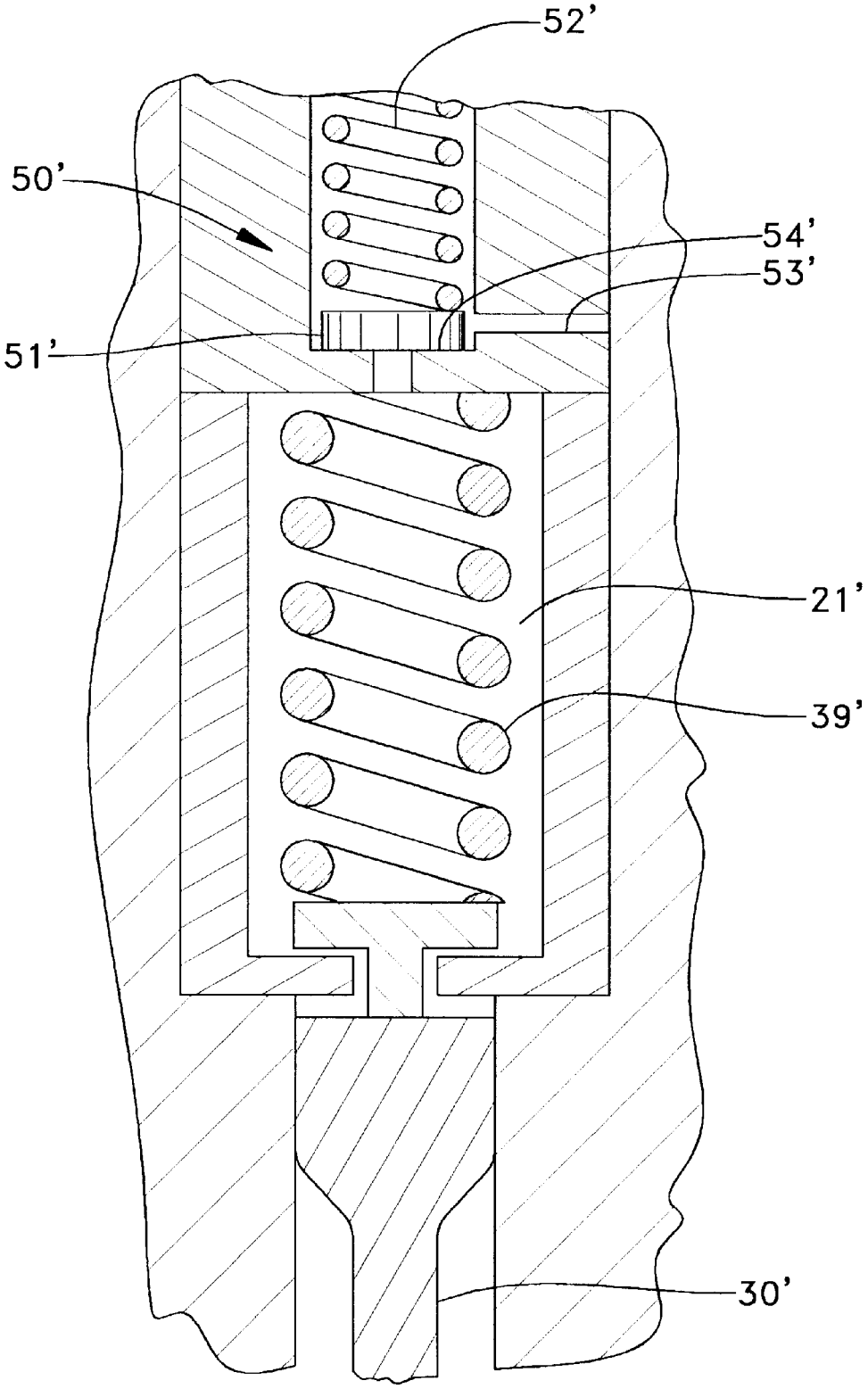
FIG. 2 is an enlarged partial front diagrammatic view of a fuel injector according to another embodiment of the present invention.

Referring now to FIG. 2, an alternative embodiment of the present invention that utilizes a plate member 51' as a substitute for the ball valve member of the previous embodiment. In this case, a biasing spring 39' is positioned in a trapped volume 21', and is operable to bias a needle valve member 30' toward its closed position. A second biasing spring 52' is operably positioned to bias plate valve member 51' against a lower seat 54' to close pressure relief passage 53' to trapped volume 21'. Like the previous embodiment, pressure regulating valve 50' remains closed unless the pressure in trapped volume 21' is above a pop-off pressure sufficient to overcome spring 52'.

Industrial Applicability

In general, trapped volume nozzle technology is desirable since it hastens the closing rate for the needle valve member 30 at the end of an injection event. This is accomplished by allowing pressure to build in trapped volume 21 to a magnitude that aids in hastening the closure rate of needle valve member 30. Those skilled in the art will appreciate that, in most instances, undesirable emissions can be decreased by providing an abrupt end to each injection event. Pressure in the trapped volume 21 will peak at the end of an injection event, and naturally decay into nozzle chamber 13 along guide bore 22 between injection events.

Because injection pressures at idle are relatively low, and the injection events themselves are spaced apart at relatively large intervals, the fluid pressure in trapped volume 21 can oftentimes decay completely between injection events. In other words, between injection events at idle, the pressure in trapped volume 21 can decay down to that about equal to the fuel pressure seen at inlet 16. This is illustrated in the left-hand side of FIG. 3. In such a case, the valve opening pressure of fuel injector 10 is defined almost entirely by the closing spring force produced by biasing spring 39. At rated conditions, injection pressures are relatively higher and the time between injection events is relatively short. Under these conditions, the pressure in trapped volume 21 achieves a higher peak pressure at the end of an injection than that of idle, and this pressure is unable to completely decay between injection events. The end result being that the valve opening pressure at rated conditions is generally significantly higher than that at idle conditions because of the combined closing force produced by hydraulic pressure acting on closing hydraulic surface 36 and that of biasing spring 39.

In general, higher valve opening pressures are desired in order to provide the best atomization of fuel when the same is initially being injected into a combustion space at the beginning of an injection event. The present invention gives one the means by which the valve opening pressure for the individual injector can be varied over its operating range, while at the same time having the ability to exploit the advantages of trapped volume nozzle technology.

Figure 3:
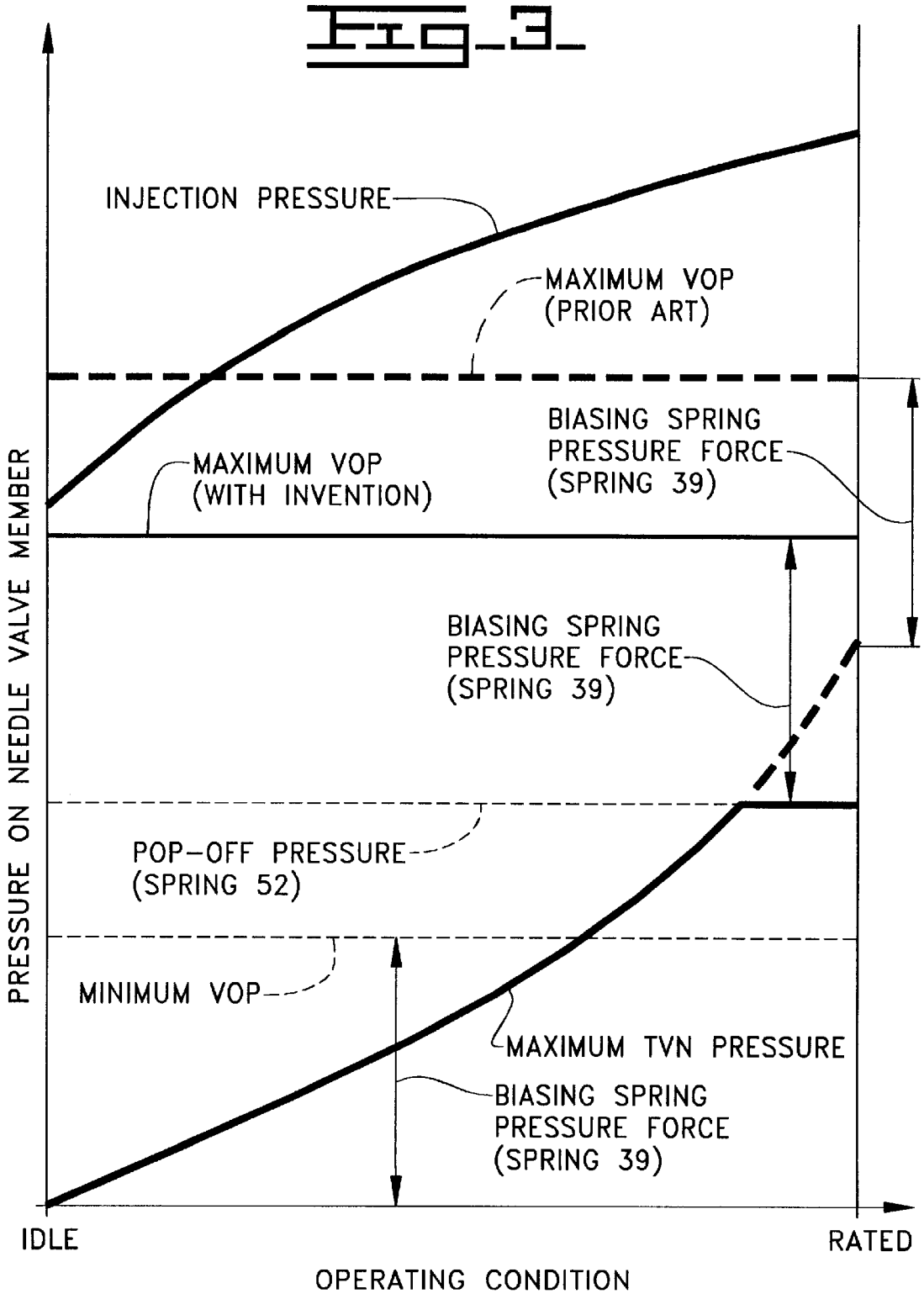
FIG. 3 is a graph of pressure versus operating condition that is utilized to illustrate various features of the present invention.

Referring now to FIG. 3, some of the valve opening pressure advantages of the present invention are illustrated. As can be seen toward the bottom of the graph, the pop-off pressure of the pressure regulating valve 50 limits the maximum pressure that is achievable within the trapped volume 21. In other words, over a substantial portion of the injector's operating range, the pressure regulating valve 50 does not come into play. Without the pressure regulating valve, the maximum steady state TVN pressure would be substantially higher as illustrated with the long dotted line extending off of the maximum TVN pressure line above the pop-off pressure level. In some instances, the maximum TVN pressure in prior art injectors combined with the biasing spring pressure could be so high as to be greater than the opening force produced by injection pressure at idle or near idle conditions. These conditions could occur in prior art injectors when the same is operating at a rated condition and then drops quickly to an idle condition. In such a case, the injection pressure at idle may not be large enough to overcome both the residual trapped volume pressure and the biasing spring pressure, and the injector will be unable to inject fuel. When the pressure regulating valve of the present invention is utilized, the maximum valve opening pressure that occurs is preferably made to be less than the injection pressure occurring at idle conditions. In other words, there is always sufficient upward opening force at idle conditions to open the needle valve member since the pressure in the trapped volume can never exceed the pop-off pressure.

Whenever the pressure regulating valve opens and releases pressure from the trapped volume, the pressure in the trapped volume drops to near that of the low fuel supply pressure. Until the pressure in the trapped volume again builds up by subsequent injection events, the needle valve member will behave as a simple check valve in accordance with the prior art fuel injectors not having the advantages of trapped volume technology. Thus, depending upon whether the injector is in a transition period or a steady state, at any given operating condition, the valve opening pressure can lay anywhere between a minimum, which is defined by biasing spring 39 up to a maximum which is defined in part by the pop-off pressure of the pressure regulating valve. An example of these minimum and maximum valve opening pressures is illustrated in FIG. 3.

In addition to the advantages previously described regarding the ability to vary valve opening pressure across the operating range of the injector while retaining the advantages of trapped volume nozzle technology, the present invention also has the ability to inhibit nozzle tip damage that can sometimes occur. In other words, since the pressure regulating valve of the present invention acts to limit the pressure in the trapped volume, one can accurately predict and control the maximum speed at which the needle valve member will close at any operating condition. Preferably, this maximum speed is less than that which will cause nozzle tip damage problems to occur.

The above description is intended for illustrative purposes only, and is not intended to limit the scope of the present invention in any way. For instance, those skilled in the art will appreciate that the pressure regulating valve can take a variety of passive or possibly active forms. In addition, the pressure release passage has been shown defined entirely in the example embodiments by the injector body, but could also at least be partially incorporated into the needle valve member itself. Finally, the valve opening pressure of fuel injectors according to the present invention can be controlled by controlling the pop-off pressure and/or the needle valve biasing spring. Thus, those skilled in the art will appreciate that the present invention can be modified significantly from the disclosed embodiments without departing from the intended scope of the invention, which is defined in terms of the claims set forth below.

I claim:

1. A fuel injector comprising:

an injector body defining a fuel inlet fluidly connected to a low pressure space, a trapped volume and a fuel pressurization chamber in fluid communication with a nozzle outlet;

a needle valve member positioned in said injector body and being movable between an inject position in which said fuel pressurization chamber is open to said nozzle outlet, and a closed position in which said nozzle outlet is blocked to said fuel pressurization chamber;

said needle valve member including a lifting hydraulic surface exposed to fluid pressure in said fuel pressurization chamber, and a closing hydraulic surface exposed to fluid pressure in said trapped volume;

at least one of said needle valve member and said injector body defining a pressure release passage extending between said trapped volume and said low pressure space; and a pressure regulating valve positioned in said pressure release passage, and having a regulating valve member movable to an open position when fluid pressure in said trapped volume is above a pop-off pressure.

2. The fuel injector of claim 1 wherein said pressure regulating valve includes a biasing spring operably positioned outside said trapped volume to bias said regulating valve member toward a closed position.

3. The fuel injector of claim 2 wherein said regulating valve member moves toward said trapped volume when moving from said open position to said closed position.

4. The fuel injector of claim 1 wherein said regulating valve member is a ball.

5. The fuel injector of claim 1 wherein said regulating valve member is a plate.

6. The fuel injector of claim 1 having an operating range between an idle operating condition and a rated operating condition; and said pressure regulating valve limiting a maximum pressure in said trapped volume over a portion of said operating range.

7. The fuel injector of claim 1 further including a biasing spring operably positioned to bias said needle valve member toward said closed position with a spring force;

said fuel injector having an idle condition in which fuel is injected at an idle pressure that defines an idle opening force acting on said lifting hydraulic surface of said needle valve member;

fluid pressure in said trapped volume defining a closing pressure force acting on said closing hydraulic surface of said needle valve member; and said idle opening force is greater than said closing pressure force plus said spring force.

8. The fuel injector of claim 1 wherein a needle valve opening pressure is defined in part by fluid pressure in said trapped volume; and means for varying said fluid pressure.

9. The fuel injector of claim 1 further including a compression spring operably positioned in said trapped volume to bias said needle valve member toward said closed position.

10. A fuel injector comprising:

an injector body defining a fuel inlet fluidly connected to a low pressure space, a trapped volume and a fuel pressurization chamber in fluid communication with a nozzle outlet;

a needle valve member positioned in said injector body and being movable between an inject position in which said fuel pressurization chamber is open to said nozzle outlet, and a closed position in which said nozzle outlet is blocked to said fuel pressurization chamber;

said needle valve member including a lifting hydraulic surface exposed to fluid pressure in said fuel pressurization chamber, and a closing hydraulic surface exposed to fluid pressure in said trapped volume;

at least one of said injector body and said needle valve member defining a pressure release passage extending between said trapped volume and said low pressure space;

a compression spring operably positioned in said trapped volume to bias said needle valve member toward said closed position; and a pressure regulating valve positioned in said pressure release passage, and having a regulating valve member movable to an open position when fluid pressure in said trapped volume is above a pop-off pressure, and further having a biasing spring operably positioned outside said trapped volume to bias said regulating valve member toward a closed position.

11. The fuel injector of claim 10 wherein said regulating valve member moves toward said trapped volume when moving from said open position to said closed position.

12. The fuel injector of claim 11 wherein said pressure regulating valve limits a maximum pressure in said trapped volume.

13. The fuel injector of claim 12 wherein said biasing spring operably positioned to bias said needle valve member toward said closed position has a spring force;

said fuel injector having an idle condition in which fuel is injected at an idle pressure that defines an idle opening force acting on said lifting hydraulic surface of said needle valve member;

fluid pressure in said trapped volume defining a closing pressure force acting on said closing hydraulic surface of said needle valve member; and said idle opening force is greater than said closing pressure force plus said spring force.

14. The fuel injector of claim 13 wherein a steady state maximum fluid pressure in said trapped volume at said idle condition is less than a steady state maximum fluid pressure at said rated condition.

15. The fuel injector of claim 14 wherein said regulating valve member is a ball.

16. The fuel injector of claim 14 wherein said regulating valve member is a plate.

17. A fuel injector comprising:

an injector body defining a fuel inlet fluidly connected to a trapped volume and a fuel pressurization chamber, which is in fluid communication with a nozzle outlet;

a needle valve member positioned in said injector body and being movable between an inject position in which said fuel pressurization chamber is open to said nozzle outlet, and a closed position in which said nozzle outlet is blocked to said fuel pressurization chamber;

said needle valve member including a lifting hydraulic surface exposed to fluid pressure in said fuel pressurization chamber, and a closing hydraulic surface exposed to fluid pressure in said trapped volume;

said needle valve member being movable toward said inject position when fuel pressure in said fuel pressurization chamber is above a valve opening pressure; and means for varying said valve opening pressure.

18. The fuel injector of claim 17 wherein said means for varying said valve opening pressure includes a means for varying fluid pressure in said trapped volume.

19. The fuel injector of claim 18 further including a biasing spring operably positioned to bias said needle valve member toward said closed position with a spring force;

said fuel injector having an idle condition in which fuel is injected at an idle pressure that defines an idle opening force acting on said lifting hydraulic surface of said needle valve member;

said fluid pressure in said trapped volume defining a closing pressure force acting on said closing hydraulic surface of said needle valve member; and said idle opening force is greater than said closing pressure force plus said spring force.

20. The fuel injector of claim 19 wherein said means for varying said valve opening pressure includes a pressure regulating valve operably positioned in said injector body to limit a maximum pressure in said trapped volume.

* * * * *